US007395007B2

(12) United States Patent
Kim

(10) Patent No.: US 7,395,007 B2
(45) Date of Patent: Jul. 1, 2008

(54) CARTRIDGE FOR USE IN AN IMAGE FORMING APPARATUS HAVING AN ELECTRONIC ELEMENT

(75) Inventor: Young-min Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/780,576

(22) Filed: Jul. 20, 2007

(65) Prior Publication Data

US 2008/0008496 A1 Jan. 10, 2008

Related U.S. Application Data

(63) Continuation of application No. 11/434,721, filed on May 17, 2006, now Pat. No. 7,305,192.

(30) Foreign Application Priority Data

Jun. 16, 2005 (KR) ..... 2005-52079

(51) Int. Cl.
*G03G 21/16* (2006.01)

(52) U.S. Cl. ..... 399/111

(58) Field of Classification Search ..... 399/24, 399/25, 27, 111

See application file for complete search history.

(56) References Cited

U.S. PATENT DOCUMENTS 4,062,061 A 12/1977 Batchelor et al.
5,697,028 A 12/1997 Kobayashi et al.
6,438,327 B1 8/2002 Kimizuka et al.

FOREIGN PATENT DOCUMENTS

JP 2001-194966 7/2001
JP 2002-328580 11/2002
JP 2002-341703 11/2002

OTHER PUBLICATIONS

U.S. Appl. No. 11/434,721, filed May 17, 2006, Young-min Kim, Samsung Electronics Co., Ltd.
Office Action issued Jul. 21, 2006 by the Korean Intellectual Property Office re: Korean Patent Application No. 2005-52079.

*Primary Examiner*—David M Gray
*Assistant Examiner*—Geoffrey T Evans
(74) *Attorney, Agent, or Firm*—Stein, McEwen & Bui, LLP

(57) ABSTRACT

A cartridge for use in an image forming apparatus comprises a charge roller to which a predetermined voltage is applied; a photosensitive drum charged by the charge roller by rotating in contact with the charge roller; an electronic element for wireless communication which is positioned at a predetermined distance from a contact line between the charge roller and the photosensitive drum; and a shielding member made of a metal which is interposed between the contact line and the electronic element to form a shielding area for shielding electromagnetic waves generated from the contact line, the electronic element being positioned within the shielding area except for boundary portions of the shielding area. As a result, the cartridge is able to efficiently shield an electronic element from electromagnetic waves generated between a photosensitive drum and a charge roller.

20 Claims, 5 Drawing Sheets

CARTRIDGE FOR USE IN AN IMAGE FORMING APPARATUS HAVING AN ELECTRONIC ELEMENT

CROSS-REFERENCE TO RELATED APPLICATIONS

This application is a continuation application of U.S. patent application Ser. No. 11/434,721, filed on May 17, 2006, now U.S. Pat. No. 7,305,192, the disclosure of which is incorporated by reference herein. This application also claims the benefit of Korean Application No. 2005-52079, filed on Jun. 16, 2005, in the Korean Intellectual Property Office, the disclosure of which is incorporated by reference herein.

BACKGROUND OF THE INVENTION

1. Field of the Invention

The present invention relates to a cartridge for use in an image forming apparatus, and more particularly, relates to a cartridge for an image forming apparatus having an arrangement structure for shielding an electronic element from electromagnetic waves.

2. Related Art

Generally, a cartridge is detachably mounted to a main body of an image forming apparatus, such as a laser printer, a facsimile, a copy machine, a multi-functional product and so on, for forming images on printable media such as paper using an electro-photographic image forming process.

As shown in FIG. 1, the cartridge 10 includes a charging roller 11, a photosensitive drum 12, a developing roller 13, and a toner container 14. The photosensitive drum 12 and a transfer roller 21 within the main body of the image forming apparatus are engaged and rotated such that a toner image is formed on an individual sheet of printable media.

Since an amount of the toner which is stored in the toner container 14 of the cartridge 10 is limited, the cartridge 10 is provided with an electronic element 15 for measuring the amount of the toner in the toner container 14 and storing the same as data. The electronic element 15 includes a communication unit and a memory unit electrically connected to the communication to store information regarding the amount of toner contained in the toner container 14 and additional information such as the specification of the cartridge, an output condition and so on.

The electronic element 15 can also be arranged to communicate with the body of the image forming apparatus to perform information providing, data recoding and renewal and so on. Recently, the electronic element 15 having wireless communications capability has been packaged in a small sized cartridge to alert of any wire contact problem. However, when the electronic element having wireless communications capability, there has been a problem in that data stored in the electronic element 15 is often damaged due to noise generated according to an electromagnetic interference.

To resolve the above problem, there has been provided U.S. Pat. No. 6,438,327 which is entitled "PROCESS CARTRIDGE HAVING STORAGE DEVICE WHICH COMMUNICATES WITH IMAGE FORMING APPARATUS", in which the electronic element 15 is positioned in a predetermined place of the cartridge 10, as shown in FIG. 1. According to this approach as disclosed by U.S. Pat. No. 6,438,327, contact lines P1, P2 and P3 between the photosensitive drum 12 and adjacent rollers, such as a charge roller 11, a developing roller 13 and a transfer roller 21, are indicated as main points in which electromagnetic waves are generated. In order to shield electromagnetic waves from the main points, as shown in FIG. 1, an electronic element 15 is attached to an inner wall of a waste toner container 16.

However, the conventional approach as disclosed by U.S. Pat. No. 6,438,327 considers only the rectilinearity of the electromagnetic waves. In other words, such a conventional approach does not consider other properties of the electromagnetic waves, including reflection, scattering and diffraction.

Meanwhile, a contact line P1 between the charge roller 11 and the photosensitive drum 12 to which the highest voltage is applied among the contact lines P1, P2 and P3 exerts great influence on the electronic element 15. Noise from the electromagnetic waves is mainly generated, when the charging voltage applied to the charge roller 11 is an alternating current (AC) voltage.

Therefore, notwithstanding the conventional approach as described by U.S. Pat. No. 6,438,327, there has been a problem in that data of the electronic element 15 included in the cartridge 10 is still damaged due to reflection, scattering and diffraction of electromagnetic waves generated from the contact line between the charge roller 11 and the photosensitive drum 12.

Accordingly, there is a need to efficiently shield an electronic element included in a cartridge from all characteristics of electromagnetic waves generated between a charge roller and a photosensitive drum.

SUMMARY OF THE INVENTION

Various aspects and example embodiments of the prevent invention provide a cartridge for use in an image forming apparatus for efficiently shielding an electronic element of such a cartridge from electromagnetic waves generated between a charge roller and a photosensitive drum.

Additional aspects and/or advantages of the invention will be set forth in part in the description which follows and, in part, will be obvious from the description, or may be learned by practice of the invention.

In accordance with an aspect of the present invention, a cartridge is provided for use in an image forming apparatus which comprises a charge roller to which a predetermined voltage is applied and a photosensitive drum charged by the charge roller by rotating in contact with the charge roller. Such a cartridge comprises an electronic element for wireless communication which is positioned at a predetermined distance from a contact line between the charge roller and the photosensitive drum; and a shielding member made of a metal which is interposed between the contact line and the electronic element to form a shielding area for shielding electromagnetic waves generated from the contact line, the electronic element being positioned within the shielding area except for boundary portions of the shielding area.

According to an aspect of the present invention, the electronic element is positioned to be laid over a virtual center surface extended from the contact line to a center portion of the shielding member.

According to an aspect of the present invention, the cartridge further comprises a casing for receiving the charging roller and the photosensitive drum, the electronic element being attached to a surface of the casing located within the shielding area.

According to an aspect of the present invention, the casing forms a plurality of surfaces which intersects with a virtual plain surface extended from the contact line to make a predetermined inclination angle, the electronic element being attached to the surface of the casing which has a minimum inclination angle.

According to an aspect of the present invention, the electronic element is positioned at a rotate angle according to a rotation thereof for minimizing a projection area of the electronic element centering around the contact line.

According to an aspect of the present invention, the shielding member further comprises a shielding reinforcement part for further forming an additional shielding area having a predetermined width in a circumference of the shielding area.

The shielding reinforcement part is integrally formed together with the shielding member.

According to an aspect of the present invention, the cartridge further comprises: a developing roller which is rotated corresponding to the photosensitive drum to develop a toner on a surface of the photosensitive drum; a doctor blade which is frictionally contacted with a surface of the developing roller to restricting a toner layer formed on the surface of the developing roller; and a blade holder for fixedly supporting the doctor blade, wherein the shielding member comprises the doctor blade and the blade holder.

According to an aspect of the present invention, the cartridge further comprises a cleaning blade for cleaning a surface of the photosensitive drum by frictionally contacting with the surface of the photosensitive drum, wherein the shielding member comprises a blade holder for fixedly supporting the cleaning blade.

In accordance with another aspect of the present invention, a cartridge for use in an image forming apparatus is provided with a charge roller to which a predetermined voltage is applied; a photosensitive drum charged by the charge roller by rotating in contact with the charge roller; a developing roller which is rotated corresponding to the photosensitive drum to develop a toner image on a surface of the photosensitive drum; a doctor blade which is frictionally contacted with a surface of the developing roller for restricting a toner layer formed on the surface of the developing roller; a blade holder made of a metal for fixedly supporting the doctor blade; and an electronic element for wireless communication which is positioned in an shielding area except for boundary portions of the shielding area, wherein the shielding area is an area in which electromagnetic waves generated from the contact line between the charging roller and the photosensitive drum are shielded by the blade holder.

According to an aspect of the present invention, the doctor blade is made of the metal, and the shielding area is the area in which the electromagnetic waves generated from the contact line between the charging roller and the photosensitive drum are shielded by the blade holder and the doctor blade.

According to an aspect of the present invention, the cartridge further comprises a casing having the charging roller, the photosensitive drum, the developing roller, the doctor blade and the blade holder, wherein the electronic element is attached a surface of the casing located within the shielding area.

According to an aspect of the present invention, the cartridge further comprises a casing having the charging roller, the photosensitive drum, the developing roller, the doctor blade and the blade holder, wherein the electronic element is attached a surface of the casing located within the shielding area.

In accordance with yet another aspect of the present invention, a cartridge for use in an image forming apparatus comprises a charge roller to which a predetermined voltage is applied; a photosensitive drum charged by the charge roller by rotating in contact with the charge roller; a cleaning blade for cleaning a surface of the photosensitive drum by frictionally contacting with the surface of the photosensitive drum; a blade holder made of a metal for fixedly supporting the cleaning blade; and an electronic element for wireless communication which is positioned in an shielding area except for boundary portions of the shielding area, wherein the shielding area is an area in which electromagnetic waves generated from the contact line between the charge roller and the photosensitive drum are shielded by the blade holder.

According to an aspect of the present invention, the cartridge further comprises a casing including the charge roller, the photosensitive drum, the cleaning blade, and the blade holder, wherein the electronic element is attached to a surface of the casing located within the shielding area.

In accordance with yet another aspect of the present invention, a cartridge for use in an image forming apparatus comprises: a photosensitive drum; charge means arranged in contact with the photosensitive drum along a length of the photosensitive drum for electrically charging the photosensitive drum by application of a bias voltage; an electronic element including a memory portion for storing data and a communication portion for effecting wireless communication of data stored in the memory portion with the image forming apparatus, positioned at a predetermined distance from a contact line between the charge means and the photosensitive drum; and a metallic shielding member interposed between the contact line and the electronic element to form a shielding area for shielding electromagnetic waves generated from the contact line between the charge means and the photosensitive drum, wherein the electronic element is positioned within the shielding area except for boundary portions of the shielding area.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
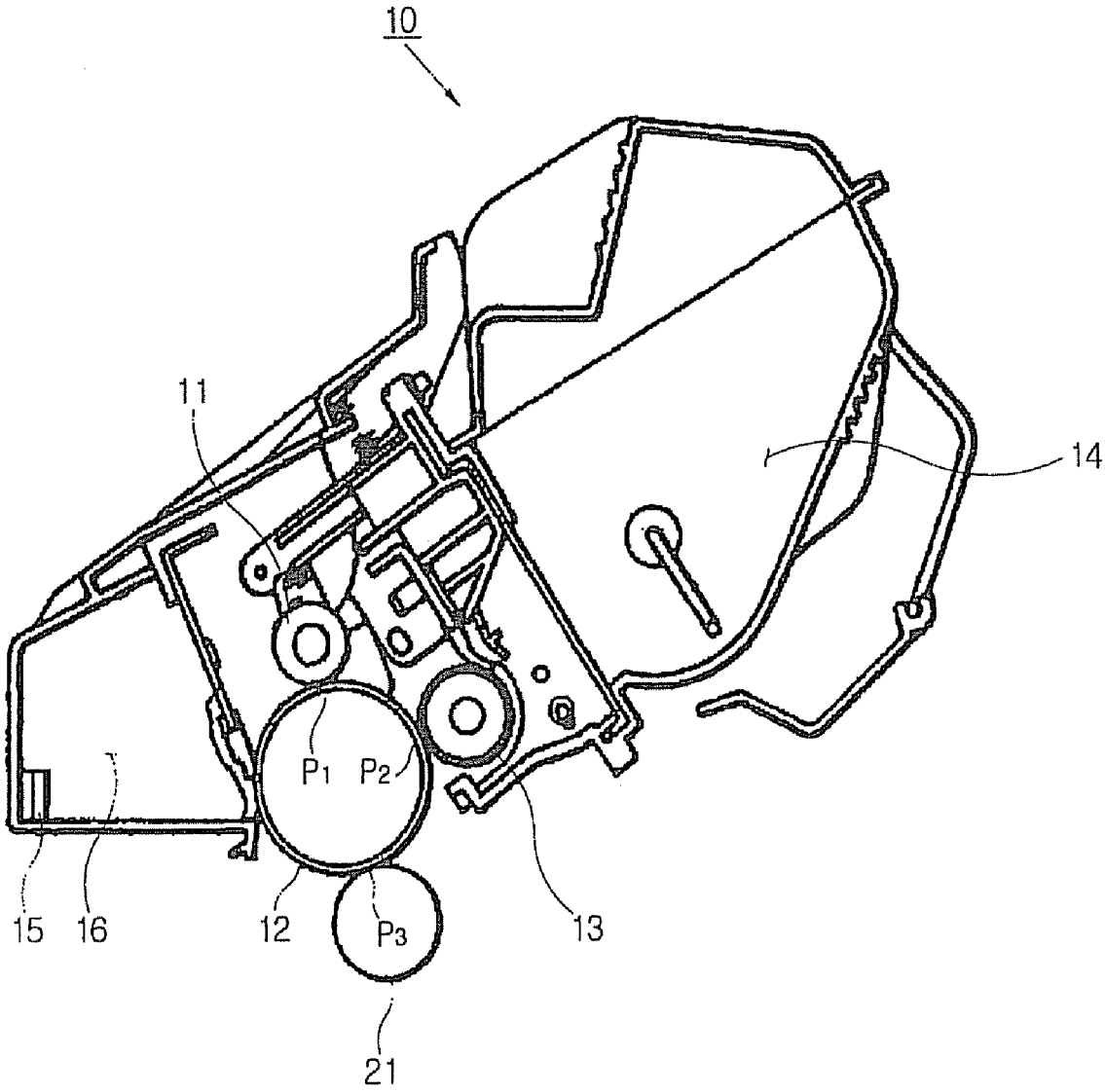
FIG. 1 is a sectional view of a typical cartridge for use in an image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
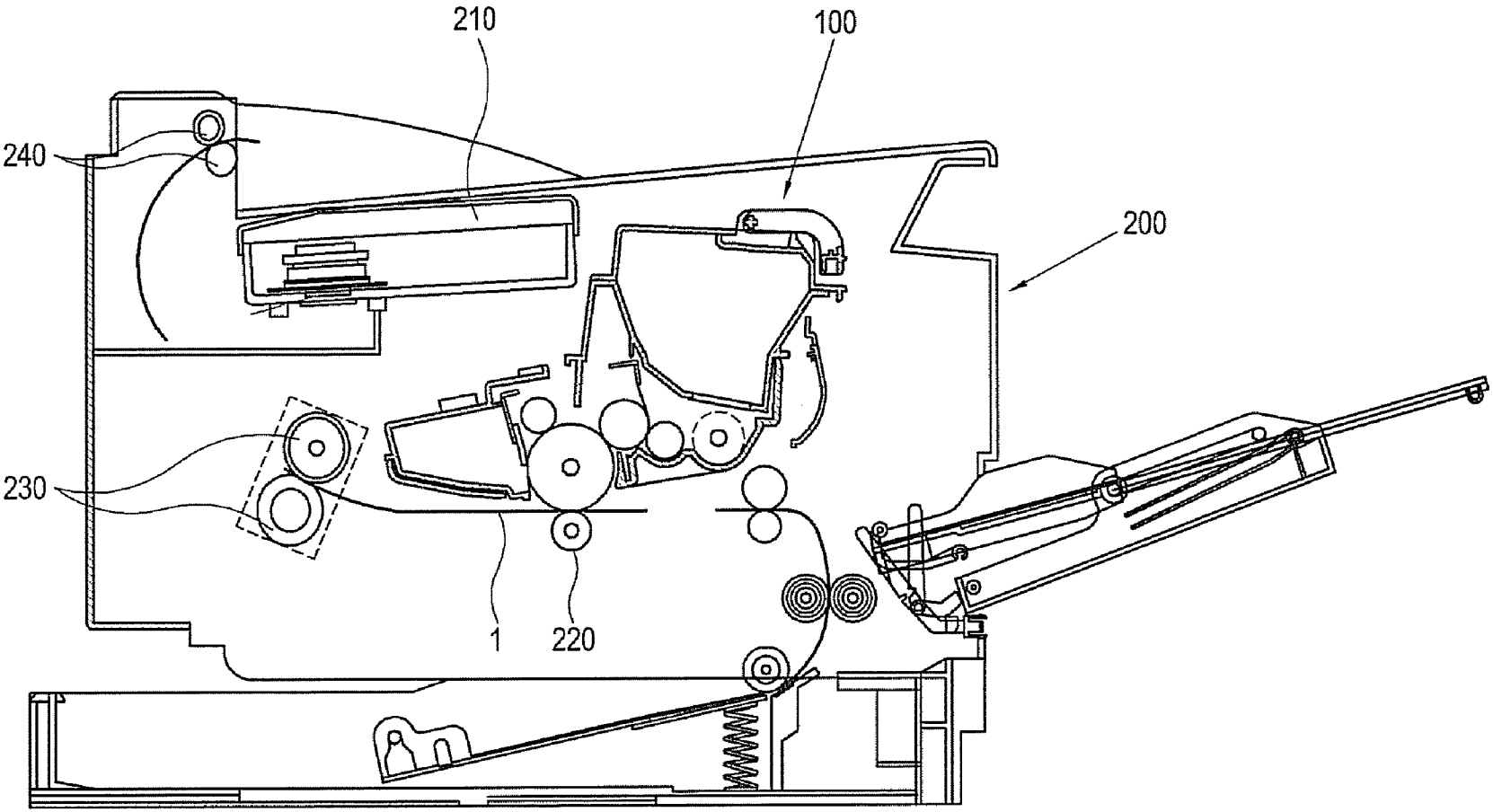
FIG. 2 is a sectional view of an example cartridge for use in an image forming apparatus according to an embodiment of the invention.

FIG. 2 illustrates an example cartridge for use in an image forming apparatus according to an embodiment of the present invention. Referring to FIG. 2, the cartridge 100 is detachably mounted in a main body 200 of the image forming apparatus, such as a laser printer, a facsimile, a copy machine, and a multi-functional product.

Figure 3:
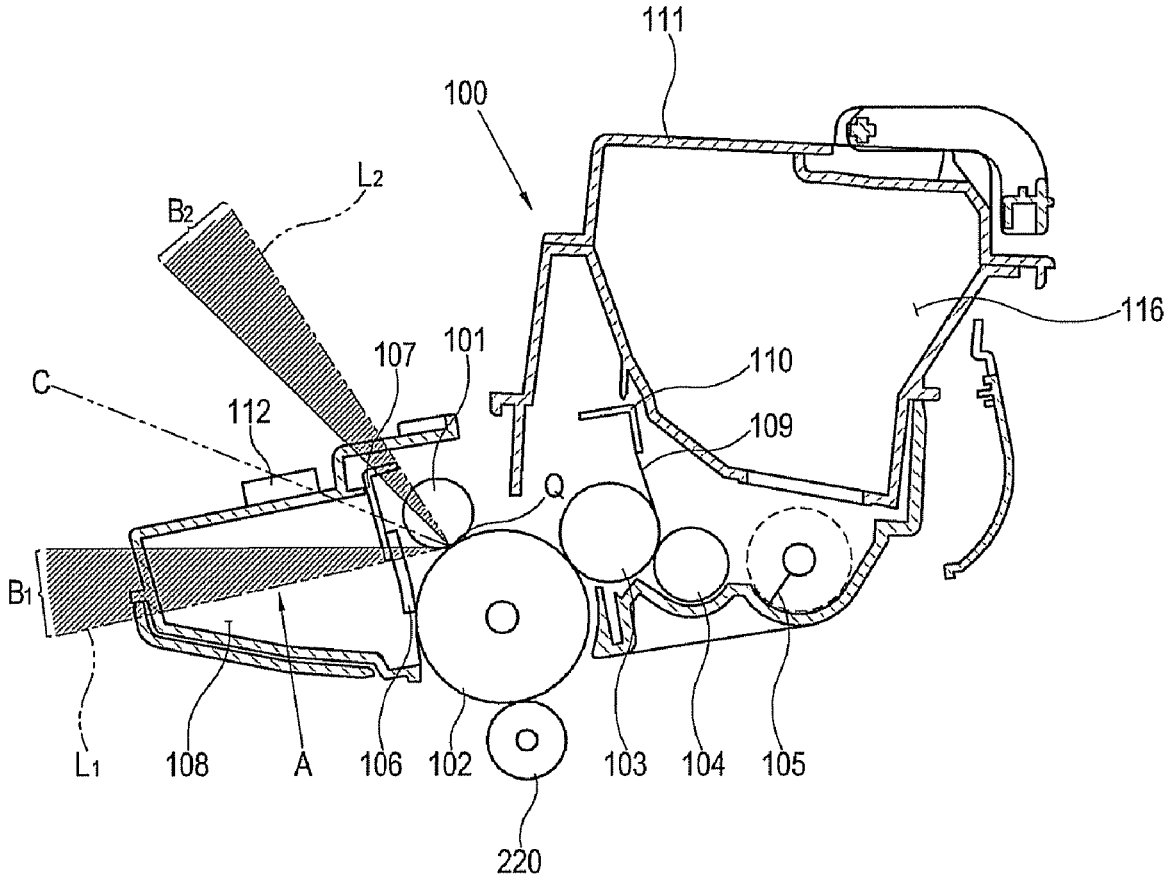
FIGS. 3 and 4 are enlarged sectional views of an example cartridge for use in an image forming apparatus shown in FIG. 2.

FIG. 3 illustrates an example cartridge shown in FIG. 2. As shown in FIG. 3, the cartridge 100 comprises a charge roller 101, a photosensitive drum 102 which is rotated in contact with the charge roller 101, a developing roller 103 which is rotated in contact with the photosensitive drum 102, and a toner container 104 which is provided on one side of the developing roller 103.

A charging voltage is applied from the main body 200 of the image forming apparatus to the charge roller 101. The charging voltage applied to the charge roller 101 charges a surface of the photosensitive drum 102 in a uniform voltage. Here, one end of the photosensitive drum 102 is connected to a ground electrode (not shown). The charging voltage can be supplied from an AC power source.

A laser light which is radiated from a laser scanning unit 210 of the body 200 of the image forming apparatus is received on the charged surface of the photosensitive drum 102 and then a latent image is formed on the surface of the photosensitive drum 102.

The portion on which the latent image is formed has a different surface voltage compared to the other portions. Thus, while the developing roller 103 having a surface on which a toner image having a predetermined thickness is attached is rotated in contact with the photosensitive drum 102, the toner image of the developing roller 102 is transferred to the portion of the surface of the photosensitive drum 102 on which the latent image is formed and then developing process is finished. Here, the developing process does not necessarily require the contact between the photosensitive drum 102 and the developing roller 103.

The toner supply to the developing roller 103 is provided by a supply roller 104 rotated in contact with the developing roller 103. The toner is supplied through a predetermined toner transferring means 105 to the supply roller 104.

The photosensitive drum 102 on the surface of which the toner image is developed by the developing roller 103 is rotated corresponding to a transfer roller 220 provided in the body 200 of the image forming apparatus. At this time, the toner image is transferred on an individual sheet 1 of printable media (such as paper) to be printed which is passed between the photosensitive drum 102 and the transfer roller 220.

When a predetermined transfer voltage is applied to the transfer roller 220, the toner image on the photosensitive drum 102 is transferred on the sheet 1 by an electric force due to the transfer voltage.

Then, while the sheet 1 on which the toner image is transferred is passed through a fusing device 230, the toner image is fixed on the sheet 1 and then the sheet 1 is discharged through a discharging roller 240 to the outside.

As shown in FIG. 3, in the left side of the photosensitive drum 102, there are provided a cleaning blade 106 which is frictionally contacted to the photosensitive drum 102 to clean the surface of the photosensitive drum 102, and a blade holder 107 for fixedly supporting one end of the cleaning blade 106.

The cleaning blade 106 can be made of an elastic material such as rubber. Such a cleaning blade 106 serves to remove the toner which remains on the photosensitive drum 102. The toner removed by the cleaning blade 106 is accumulated in a waste toner container 108. The photosensitive drum 102 cleaned by the cleaning blade 106 is again charged in a uniform surface voltage by the charge roller 101.

Further, in the right side of the developing roller 103, there are provided a doctor blade 109 which is frictionally contacted to the developing roller 103 to uniformly restrict the thickness of the toner image formed on the developing roller 103, and a blade holder 110 for fixedly supporting one end of the doctor blade 109.

The doctor blade 109 can be made of a metal plate with an elastic property. Such a doctor blade 109 serves to uniformly control the amount of the toner transferred from the developing roller 103 to the photosensitive drum 102 to be developed by uniformly restricting the toner on the surface of the developing roller 103.

The above explained two blade holders 107 and 110 are made of a metal and are respectively and fixedly attached to a casing 111 of the cartridge 100.

Meanwhile, the casing 111 on a side corresponding to the waste toner container 108 is provided with a predetermined electronic element 112 on an outer surface thereof. The electronic element 112 may include a memory unit (not shown) for storing information such as information of the cartridge 100, the remaining amount of toner and so on, and a wireless communication unit (not shown) electrically connected with the memory unit. In such a case, the electronic element 112 performs recording, storing and renewal of data, while exchanging wireless data with a communication device (not shown) provided in the body 200 of the image forming apparatus. In addition, the electronic element 112 may also inform a user of information about the cartridge 100 or sending the cartridge information to another external device of the body 200 of the image forming apparatus.

The electronic element 112, as shown in FIG. 3, is positioned at a uniform distance from the contact line Q between the charge roller 101 and the photosensitive drum 102. The blade holder 107 made of a metal is interposed between the contact line Q and the electronic element 112. The blade holder 107 functions as a shielding member for shielding the electronic element 112 from electromagnetic waves generated from the contact line Q between the charge roller 101 and the photosensitive drum 102.

Here, the shielding member for shielding the electronic element 112 from the electromagnetic waves may use a plate shaped metal member which is separately provided within the cartridge 100 besides the blade holder 107. Otherwise, the casing 111 may shield the electronic element 12 from the electromagnetic waves by allowing a whole or a part of the casing 111 having a predetermined shape to be made of metal.

Referring again to FIG. 3, the shielding area which the electromagnetic waves are shielded from the contact line Q by the blade holder 107 has boundary surfaces L1 and L2. Further, the electronic element 112 is positioned to be laid across a vertical center surface C extended from the contact line Q to the center portion of the blade holder 107. By this, the electronic element 112 is positioned at the farthest place from the both boundary surfaces L1 and L2 in the shielding area A.

According to this embodiment of the present invention, the electronic element 12 may be fixedly positioned by a specially provided fixing member (not shown).

The shielding area A corresponds to an area in which the rectilinearity of the electromagnetic waves generated from the contact line Q between the charge roller 101 and the photosensitive drum 102 is shielded. However, the electromagnetic waves may still have influence on boundary portions B1 and B2 having a predetermined area positioned in a region of the boundary surfaces L1 and L2 of the shielding area A due to reflection, scattering and diffraction. Thus, the electronic element 112 is required to be placed in a space for fully protecting the influence of the electromagnetic waves.

According to this embodiment of the present invention, the electronic element 112 is positioned to be laid across the center surface C of the shielding area A in order to avoid the above influence of the electromagnetic waves, including any reflection, scattering and diffraction of such electromagnetic waves to the maximum.

Meanwhile, in order to efficiently shield the electromagnetic waves from the electronic element 112, the blade holder 107 may be additionally formed with a predetermined shielding reinforcement part (not shown) at a circumference part thereof. In case of forming the shielding reinforcement part on the circumference part of the blade holder 107, an additional shielding area having a predetermined width is formed along the circumference of the shielding area A, in which the effect for shielding the electromagnetic waves the electronic element 112 is enhanced. The shielding reinforcement part may be integrally formed together with the blade holder 107. Otherwise, such a shielding reinforcement part may be formed by adding a separate member to the blade holder 107. Furthermore, the shielding reinforcement part may be formed by integrally forming together with a separate shielding member or adding to the same.

Further, in order to minimize the influence of the electromagnetic waves which infiltrates the shielding area "A" beyond the boundary surfaces L1 and L2, a fixing angle of the electronic element 112 as well as a fixing position thereof should by considered. Specifically, the electronic element 112 is disposed at the rotating angle which minimizes the projection area of the electronic element 112 centering around the contact line Q as rotating the electronic element 112.

Figure 4:
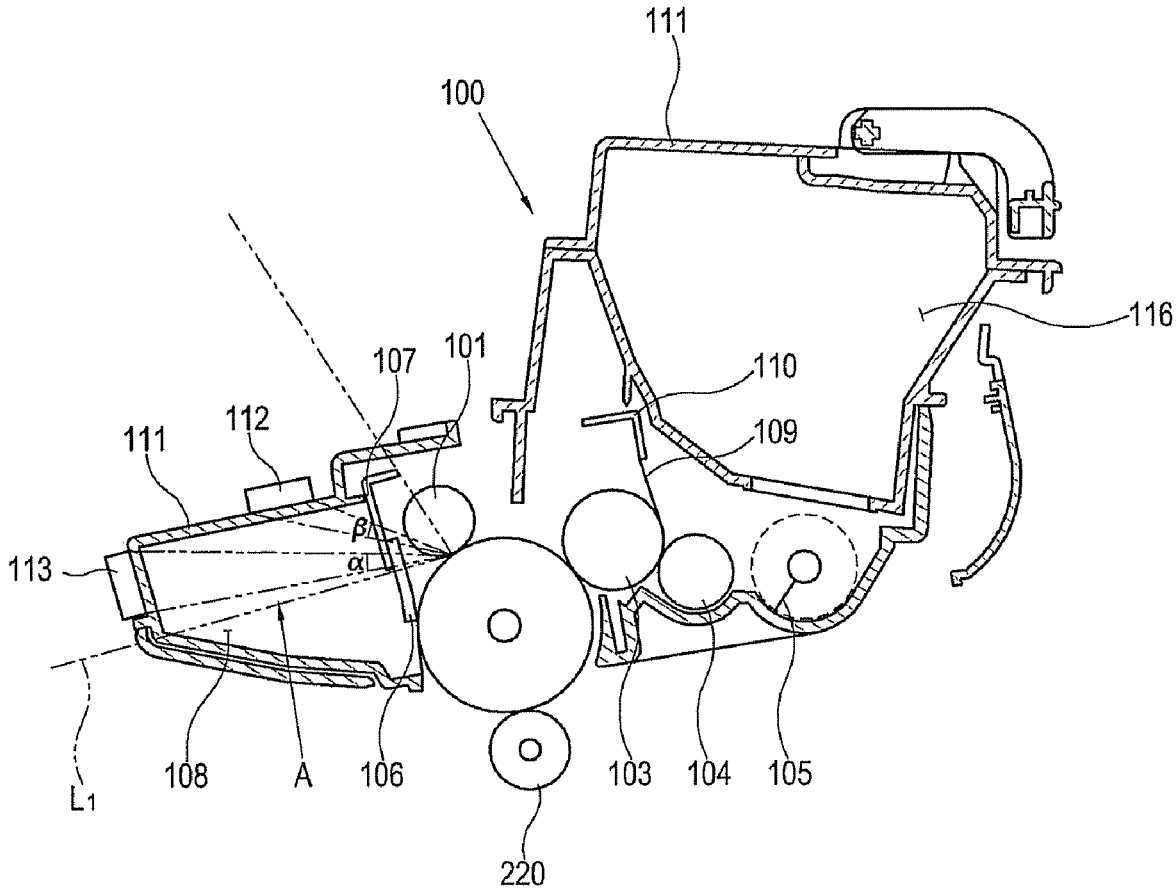

For example, as shown in FIG. 4, assuming that an electronic element 113 is attached to an external surface of a left side of the casing 111 of the cartridge 100, as the projection area projected from the contact line Q (that is, an angle a occupied by the electronic element 113) is large, the electromagnetic waves which are reflected, scattered or diffracted have a great influence on the electronic element 113 that much. However, according to this embodiment of the present invention, in case of attaching the electronic element 112 to an external surface of an upper side of the casing 111, as the projection area projected from the contact line Q (that is, an angle β occupied by the electronic element 12) is small, the electromagnetic waves also have a little influence on the electronic element 112.

Thus, when attaching the electronic element 112 to a surface of the casing 111, it is preferable to minimize the projection area projected from the contact line Q.

At this time, in order to minimize the projection area, an attaching medium for adjusting the rotating angle of the electronic element 112 may be interposed between the electronic element 112 and the casing 111.

Figure 5:
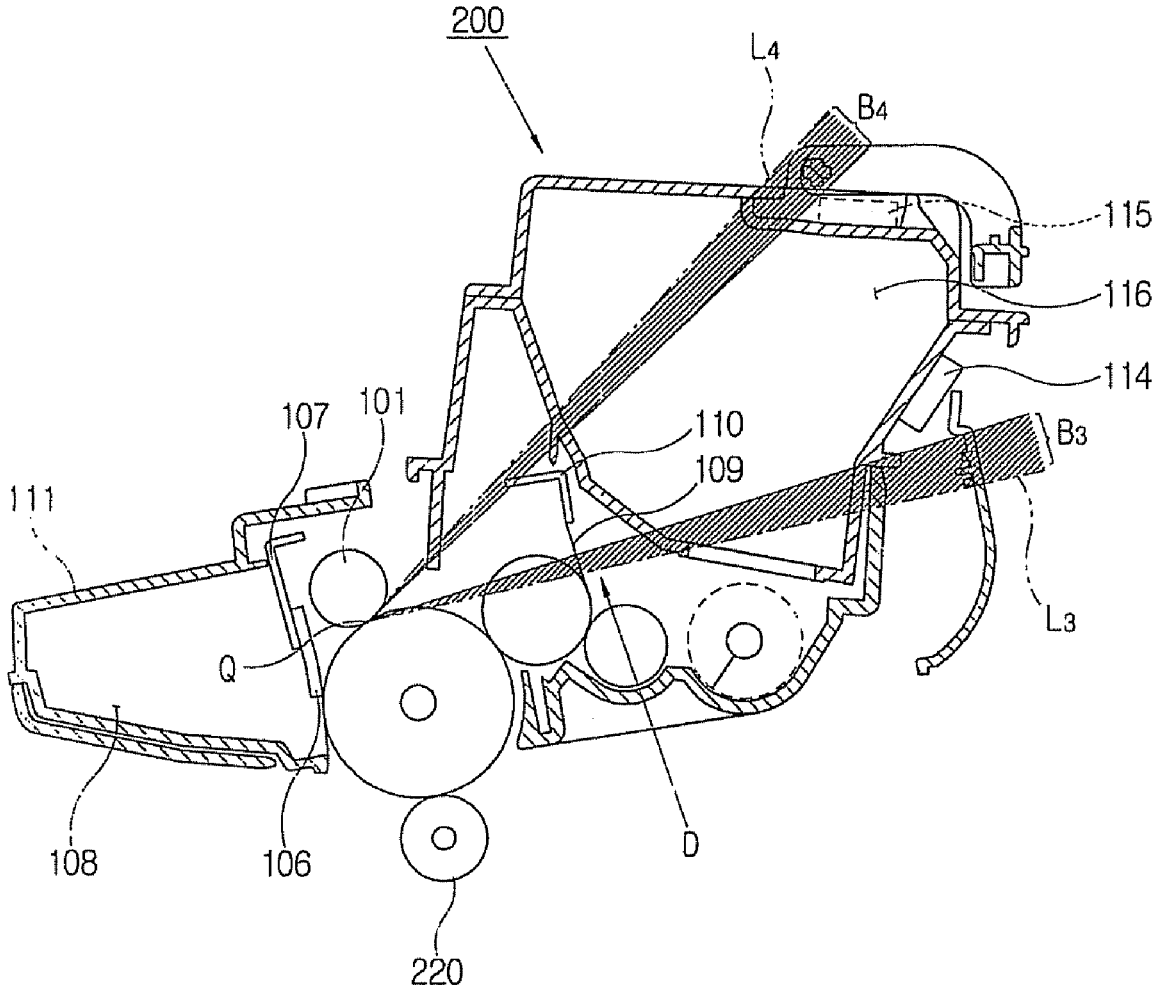
FIG. 5 is a sectional view of an example cartridge for use in an image forming apparatus according to another embodiment of the invention.

FIG. 5 illustrates an example cartridge for use in an image forming apparatus according to another embodiment of the present invention. As shown in FIG. 5, the cartridge 200 includes many similar components as that shown in FIG. 2, FIG. 3 and FIG. 4. However, in FIG. 5, an electronic element 114 is positioned within a shielding area D in which the contact line Q is shielded by the doctor blade 109 and the blade holder 110.

As explained in the embodiment shown in FIG. 2, FIG. 3 and FIG. 4, the shielding area D has boundary portions B3 and B4 which are expected to have an influence such as reflection, scattering and diffraction of electromagnetic waves on boundary surfaces L3 and L4. The electronic element 114 is positioned at a portion except for the boundary portions B3 and B4 within the shielding area D to fully remove the influence of the electromagnetic waves. According to this embodiment of the present invention, the electronic element 14, as shown in FIG. 5, is attached to a surface of the casing 111 of the toner container 116 so as to accomplish the above requirement.

Similarly to the embodiment shown in FIG. 2, FIG. 3 and FIG. 4, a shielding reinforcement member (not shown) may be further formed to the doctor blade 109 or the blade holder 110 to ensure additional shielding area for reinforcing the shielding of the electronic element 114.

Further, when considering an attaching angle of the electronic element 114 for minimizing the projection area projected from the contact line Q, the electronic element 114 may be attached to a part 115 shown in dotted line at an upper part of the casing 111.

As described in the foregoing, according to a cartridge for use in an image forming apparatus according to aspects of the present invention, an electronic element can be efficiently shielded from electromagnetic waves generated from the contact line between the charge roller and the photosensitive drum, that is, the effects of noise generated by the charge bias applied to the charge roller. As a result, the electronic element can be smoothly operated to ensure that data stored therein is accurately kept and is prevented from being destroyed or written over with erroneous data.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, the components of the cartridge as shown in FIG. 3 and FIG. 4 can be implemented differently, and likewise, an electronic element can be positioned differently as long as an electronic element is fully shielded from all forms of electromagnetic waves, including reflection, scattering and diffraction of electromagnetic waves generated from the contact line between a charge roller and a photosensitive drum, as well as a contact line between the developing roller and the photosensitive drum and a contact line between the transfer roller and the photosensitive drum. Moreover, the shielding element can be other components of the cartridge and a part of the casing of the cartridge as long as it can effectively form a shielding area for shielding electromagnetic waves generated from the contact line. Accordingly, it is intended, therefore, that the present invention not be limited to the various example embodiments disclosed, but that the present invention includes all embodiments falling within the scope of the appended claims.

What is claimed is:

1. A cartridge for an image forming apparatus, comprising:

a charge roller to which a predetermined voltage is applied;

a photosensitive drum charged by the charge roller by rotating in contact with the charging roller;

a casing to house the charge roller and the photosensitive drum;

an electronic element positioned at a predetermined distance from a contact line between the charging roller and the photosensitive drum, for wireless communications;

an attaching medium interposed between the electronic element and the casing to adjust a rotating angle of the electronic element; and a shielding member made of a metal interposed between the contact line and the electronic element to form a shielding area to shield electromagnetic waves generated from the contact line between the charging roller and the photosensitive drum, wherein the electronic element is disposed on a surface of the casing within the shielding area, except for boundary portions of the shielding area to avoid an influence of the electromagnetic waves at boundary surfaces of the shielding area, including any reflection, scattering and diffraction of the electromagnetic waves.

2. The cartridge according to claim 1, wherein the electronic element is positioned to be laid over the surface of the casing that is a center of the shielding area extended from the contact line to a center portion of the shielding member, that is farthest from the boundary surfaces of the shielding area.

3. The cartridge according to claim 1, wherein the electronic element is attached to an outer surface of the casing located within the shielding area.

4. The cartridge according to claim 1, wherein the predetermined voltage can be supplied from an AC power source.

5. The cartridge according to claim 1, wherein the shielding member further comprises a shielding reinforcement part to form an additional shielding area having a predetermined width in a circumference of the shielding area.

6. The cartridge according to claim 1, wherein a shielding reinforcement part is integrally formed together with the shielding member.

7. The cartridge according to claim 1, further comprising:

a developing roller arranged to rotate in correspondence with the photosensitive drum to develop a toner image on a surface of the photosensitive drum;

a doctor blade frictionally contacted with a surface of the developing roller to restrict a toner image formed on the surface of the developing roller; and a blade holder to support fixedly the doctor blade, wherein the shielding member comprises the doctor blade and the blade holder.

8. The cartridge according to claim 1, further comprising a cleaning blade to clean a surface of the photosensitive drum by frictionally contacting with the surface of the photosensitive drum, wherein the shielding member comprises a blade holder to support fixedly the cleaning blade.

9. The cartridge according to claim 8, wherein the predetermined voltage can be supplied from an AC power source.

10. A cartridge for an image forming apparatus comprising a charge roller to which a predetermined voltage is applied, a photosensitive drum charged by the charge roller by rotating in contact with the charge roller, a developing roller which is rotated corresponding to the photosensitive drum to develop a toner image on a surface of the photosensitive drum, a doctor blade which is frictionally contacted with a surface of the developing roller to restrict a toner image formed on the surface of the developing roller, a blade holder made of a metal to support fixedly the doctor blade, and a casing to house the charge roller, the photosensitive drum, the developing roller, the doctor blade and the blade holder, further comprising:

an electronic element positioned in a shielding area for wireless communications, wherein the shielding area is an area in which electromagnetic waves generated from a contact line between the charge roller and the photosensitive drum are shielded by the blade holder; and an attaching medium interposed between the electronic element and the casing to adjust a rotating angle of the electronic element, wherein the electronic element is positioned on a surface of the casing within the shielding area, except for boundary portions of the shielding area to avoid an influence of the electromagnetic waves at boundary surfaces of the shielding area, including any reflection, scattering and diffraction of the electromagnetic waves.

11. The cartridge according to claim 10, wherein the doctor blade is made of the metal, and the shielding area is the area in which the electromagnetic waves generated from the contact line between the charge roller and the photosensitive drum are shielded by the blade holder and the doctor blade.

12. The cartridge according to claim 11, wherein the electronic element is attached to an inner surface of the casing located within the shielding area.

13. The cartridge according to claim 12, wherein the predetermined voltage can be supplied from an AC power source.

14. The cartridge according to claim 10, wherein the electronic element is attached to an outer surface of the casing located within the shielding area.

15. A cartridge for an image forming apparatus comprising a charge roller to which a predetermined voltage is applied, a photosensitive drum charged by the charge roller by rotating in contact with the charge roller, a cleaning blade to clean a surface of the photosensitive drum by frictionally contacting with the surface of the photosensitive drum, a blade holder made of a metal to support fixedly the cleaning blade, and a casing to house the charger roller, the photosensitive drum, the cleaning blade and the blade holder, further comprising:

an electronic element positioned in a shielding area for wireless communications; and an attaching medium interposed between the electronic element and the casing to adjust a rotating angle of the electronic element, wherein the shielding area is an area in which electromagnetic waves generated from a contact line between the charging roller and the photosensitive drum are shielded by the blade holder, and wherein the electronic element is positioned on a surface of the casing within the shielding area, except for boundary portions of the shielding area to avoid an influence of the electromagnetic waves at boundary surfaces of the shielding area, including any reflection, scattering and diffraction of the electromagnetic waves.

16. The cartridge according to claim 15, further wherein the electronic element is attached to an outer surface of the casing located within the shielding area.

17. An electronic unit for a cartridge comprising a charge roller to which a predetermined voltage is applied, a photosensitive drum charged by the charge roller by rotating in contact with the charging roller, and a casing to house the charge roller and the photosensitive drum, comprising:

an electronic element positioned at a predetermined distance from a contact line between the charging roller and the photosensitive drum, for wireless communications;

an attaching medium interposed between the electronic element and the casing to adjust a rotating angle of the electronic element; and a shielding member made of a metal interposed between the contact line and the electronic element to form a shielding area to shield electromagnetic waves generated from the contact line between the charging roller and the photosensitive drum, wherein the electronic element is positioned on a surface of the casing within the shielding area, except for boundary portions of the shielding area to avoid an influence of the electromagnetic waves at boundary surfaces of the shielding area, including any reflection, scattering and diffraction of the electromagnetic waves.

18. The electronic unit according to claim 17, wherein the electronic element is positioned to be laid over the surface of the casing that is a center of the shielding area extended from the contact line to a center portion of the shielding member, that is farthest from the boundary surfaces of the shielding area.

19. The electronic unit according to claim 17, wherein the electronic element is attached to an outer surface of the casing located within the shielding area.

20. The electronic unit according to claim 17, wherein the predetermined voltage is supplied from an AC power source.

* * * * *